United States Patent [19]

Chen et al.

[11] Patent Number: 4,919,834

[45] **Date of Patent: * Apr. 24, 1990**

[54] PACKAGE FOR CONTROLLING THE STABILITY OF A LIQUID NONAQUEOUS DETERGENT

[75] Inventors: Loren Chen, Pleasanton; Gregory van Buskirk, Danville; David Peterson, Pleasanton; Robert J. Iliff, Oakley, all of Calif.

[73] Assignee: The Clorox Company, Oakland, Calif.

[ * ] Notice: The portion of the term of this patent subsequent to Oct. 17, 2006 has been disclaimed.

[21] Appl. No.: 251,646

[22] Filed: Sep. 28, 1988

[51] Int. Cl.[5] ..... C11D 1/66; C11D 3/34; C11D 17/04; C11D 17/08

[52] U.S. Cl. ..... 252/90; 252/40; 252/106; 252/559; 252/139; 206/524.6

[58] Field of Search ..... 252/110, 106, 559, 139, 252/90

[56] References Cited

U.S. PATENT DOCUMENTS

| | | | |
|---|---|---|---|
| 3,169,930 | 2/1965 | Gedge | 252/137 |
| 3,625,909 | 12/1971 | Berg et al. | 252/153 |
| 3,630,929 | 12/1971 | van Dijk | 252/136 |
| 3,640,885 | 2/1972 | Rhees | 252/186 |
| 3,661,786 | 5/1972 | Desforges | 252/99 |
| 3,723,327 | 3/1973 | van Kampen et al. | 252/110 |
| 3,784,476 | 1/1974 | van Kampen et al. | 252/109 |
| 3,789,001 | 1/1974 | Painelli | 252/99 |
| 3,798,181 | 3/1974 | Vazquez | 252/539 |
| 3,950,277 | 4/1976 | Stewart et al. | 252/541 |
| 4,001,132 | 1/1977 | Maguire | 252/105 |

(List continued on next page.)

FOREIGN PATENT DOCUMENTS

| | | |
|---|---|---|
| 158464 | 10/1985 | European Pat. Off. . |
| 177183 | 4/1986 | European Pat. Off. . |
| 225654 | 6/1987 | European Pat. Off. . |
| 234867 | 9/1987 | European Pat. Off. . |
| 2173224 | 10/1986 | United Kingdom . |
| 2194536 | 3/1988 | United Kingdom . |
| 2195125 | 3/1988 | United Kingdom . |
| 2195649 | 4/1988 | United Kingdom . |
| 2196347 | 4/1988 | United Kingdom . |
| 2196981 | 5/1988 | United Kingdom . |
| 2200366 | 8/1988 | United Kingdom . |

OTHER PUBLICATIONS

U.S. Patent Application Ser. No. 07/083,753, filed Aug. 7, 1987, of Colborn et al., entitled "Mitigation of Stress--Cracking in Fragranced Bleach-Containing Bottles", pending in Group Art Unit 223, of common assignment.

*Primary Examiner*—Dennis Albrecht
*Assistant Examiner*—Jeff Darland
*Attorney, Agent, or Firm*—Joel J. Hayashida; Michael J. Mazza; Stephen M. Westbrook

[57] ABSTRACT

The present invention provides a package for a phase stable, liquid nonaqueous detergent, comprising:

a plastic, relatively thin-walled container, said container having an end wall and a circumscribing side wall which narrows to a finish, and a liquid detergent contained in said container, said detergent comprising:

(a) 20–90% of a liquid portion which comprises an alkoxylated nonionic surfactant;

(b) 5–50% of a solids portion which comprises:

(i) a builder;

(ii) 0–20% of the detergent of an oxidant; said solids being stably suspended in said liquid portion, by means of (c) a phase stabilizing amount of a lower alkylated fused ring polyarylene sulfonate; and (d) 0–5% of a hydrolytic enzyme;

whereby the phase stability of said liquid detergent in storage in said container is controlled, by the selection of either:

(1) said container being constructed of a homopolymeric resin, said container having a minimum average cross-sectional dimension r/2 of at least about 6.8 millimeters in order to minimize interaction with said plastic;

(2) said container being constructed of a heteroatom-containing polymer; or (3) a combination thereof.

8 Claims, 1 Drawing Sheet

U.S. PATENT DOCUMENTS

| | | | |
|---|---|---|---|
| 4,014,806 | 3/1977 | Conner et al. | 252/110 |
| 4,081,395 | 3/1978 | Talley | 252/106 |
| 4,101,457 | 7/1978 | Place et al. | 252/559 |
| 4,107,067 | 8/1978 | Murphy et al. | 252/135 |
| 4,123,395 | 10/1978 | Maguire et al. | 252/559 |
| 4,162,987 | 7/1979 | Maguire et al. | 252/135 |
| 4,201,686 | 5/1980 | Augustijn | 252/174.22 |
| 4,234,444 | 11/1980 | Wegener et al. | 252/174.22 |
| 4,264,466 | 4/1981 | Carleton et al. | 252/158 |
| 4,272,394 | 6/1981 | Kaneko | 252/99 |
| 4,294,717 | 10/1981 | Couderc et al. | 252/97 |
| 4,316,812 | 2/1982 | Hancock et al. | 252/99 |
| 4,326,976 | 4/1982 | Logan et al. | 252/99 |
| 4,326,979 | 4/1982 | Bus et al. | 252/158 |
| 4,340,766 | 7/1982 | Klahr et al. | 568/625 |
| 4,349,448 | 9/1982 | Steele | 252/135 |
| 4,409,136 | 10/1983 | Cheng | 252/540 |
| 4,438,014 | 3/1984 | Scott | 252/174.21 |
| 4,648,987 | 3/1987 | Smith et al. | 252/559 |
| 4,650,599 | 3/1987 | Farnworth et al. | 252/99 |
| 4,661,452 | 4/1987 | Markussen et al. | 435/187 |
| 4,707,291 | 11/1987 | Thom et al. | 252/174.12 |
| 4,743,394 | 5/1988 | Kaufmann et al. | 252/90 |
| 4,753,750 | 6/1988 | Ouhadi et al. | 252/139 |
| 4,772,412 | 9/1988 | Green et al. . | |

PACKAGE FOR CONTROLLING THE STABILITY OF A LIQUID NONAQUEOUS DETERGENT

BACKGROUND OF THE INVENTION

1. Field of the Invention

This invention relates to a container for a phase stable, liquid nonaqueous detergents, which contain enzymes and oxidants, and have prolonged physical stability, even at elevated temperatures for extended periods of time. The careful selection of certain dimensions of the container result in the control of phase instability owing to the interaction of detergent and plastic.

2. Brief Description of the Prior Art

There are many instances of liquid, nonaqueous detergent formulations in the prior art. Maguire et al., U.S. Pat. No. 4,123,395, discloses an automatic dishwasher detergent composition comprising a low-foaming nonionic surfactant and a sulfonated aromatic compatibilizing agent having a CMC greater than 1% by weight at 25° C., in which the nonionic:sulfonated compatibilizing agent ratio is 2:5 to about 5:3, and the composition is a paste, a gel or a nonaqueous liquid. The compositions of Maguire would be inappropriate for use as a laundry detergent. Automatic dishwashers generally wash dishes at much higher temperatures than washing machines launder clothing, and the type of foaming surfactants utilized in laundry detergents would be inappropriate for use in ADWD's. Further, Maguire does not teach, disclose or suggest the need to provide phase stable, substantially nonaqueous liquid detergents.

van Dijk, U.S. Pat. No. 3,630,929, discloses a substantially nonaqueous liquid detergent consisting essentially of nonionic surfactant, detergent builder, an inorganic carrier, and an acid solubilizer. This reference discloses the need to use an inorganic carrier to prevent phase separation. However, the use of such inorganic materials apparently has deleterious effects on solubility of the composition, since an acid solubilizer, such as acetic acid must also be present.

Carleton et al., U.S. Pat. No. 4,264,466, discloses a liquid detergent mull comprising a dispersed solid in a liquid nonionic surfactant, which is stabilized by a chain structure clay. This particular formulation suggests that a "chain structure type" clay must be present as a suspending material. Applicants however, have found that chain structure type clays adversely affect solubility of liquid detergent formulations. Moreover, chain structure clays have also been found to cause deleterious results in solubility and pourability upon storage, and also upon the addition of extraneous water, in substantially nonaqueous liquid detergents.

Hancock et al., U.S. Pat. No. 4,316,812, discloses a liquid, nonaqueous detergent comprising a dispersion of solids in a liquid nonionic surfactant having a pour point of less than 10° C., in which the solids comprise builders and an oxygen bleach, and there is allegedly no dispersant for the solids. However, Hancock apparently does require a dispersant which is either a finely divided silica (Aerosil), a polyethylene glycol, or both (Cf. Examples 1, 2 and 5 of Hancock).

However, the art does not disclose, teach or suggest that lower alkylated sulfonated, fused ring arylenes can dramatically and unexpectedly improve physical stability of liquid, nonaqueous detergents. Moreover, none of the art discloses, teaches or suggests that a phase stabilizer which is a sulfonated, lower alkyl fused ring arylene has dramatic and unexpected physical stabilizing properties in substantially nonaqueous liquid detergents. Additionally, Colborn et al., U.S. patent application Ser. No. 07/083,753, filed Aug. 7, 1987, now U.S. Pat. No. 4,865,633 entitled "MITIGATION OF STRESS-CRACKING IN STACKED LOADS OF FRAGRANCED BLEACH-CONTAINING BOTTLES," of common assignment herewith, discloses and claims a packaging system in which plastic bottles contain an essentially all aqueous perfumed bleach formulation, in which stress-cracking of the plastic bottles is mitigated by using a hydrotrope to disperse the perfume rather than a surfactant.

However, none of any of the foregoing references discloses, teaches or suggests the use of particular materials or dimensions in a plastic container to reduce or mitigate phase instability caused by plastic/liquid nonaqueous detergent interaction.

SUMMARY OF THE INVENTION AND OBJECTS

The invention comprises, a packaged phase stable, liquid nonaqueous detergent, comprising:

a plastic, relatively thin-walled container, said container having an end wall and a circumscribing side wall which narrows to a finish, and a liquid detergent contained in said container, said detergent comprising:

(a) 20–90% of a liquid portion which comprises an alkoxylated nonionic surfactant;

(b) 5–50% of a solids portion which comprises:

(i) a builder;

(ii) 0–20% of the detergent of an oxidant; said solids being stably suspended in said liquid portion, by means of (c) a phase stabilizing amount of a lower alkylated fused ring polyarylene sulfonate; and (d) 0–5% of a hydrolytic enzyme;

whereby the phase stability of said liquid detergent in storage in said container is controlled, by the selection of either:

(1) said container being constructed of a homopolymeric resin, said container having a minimum average cross-sectional dimension r/2 of at least about 6.8 millimeters in order to minimize interaction with said plastic;

(2) said container being constructed of a heteroatom-containing copolymer; or (3) a combination thereof.

It is therefore an object of this invention to minimize phase instability in a liquid, substantially nonaqueous detergent by careful selection of the material and dimensions of the container in which such detergent is stored.

It is another object of this invention to maintain the phase stability of a liquid, substantially nonaqueous detergent by selecting a homopolymeric resin as a construction material, but maintaining the r/2 of a substantially cylindrical container constructed therefrom at greater than or equal to 6.8 mm.

It is a further object of this invention to maintain the physical stability of a liquid, substantially nonaqueous detergent in a plastic container at extended storage times and elevated temperatures.

It is another object of this invention to control the phase separation of a substantially nonaqueous liquid detergent in which a solid, oxidant, a builder, and an enzyme can be present for soil and stain removal, by constructing the container containing said liquid detergent from a heteroatom-containing resin.

DETAILED DESCRIPTION OF THE PREFERRED EMBODIMENTS

Figure 1:
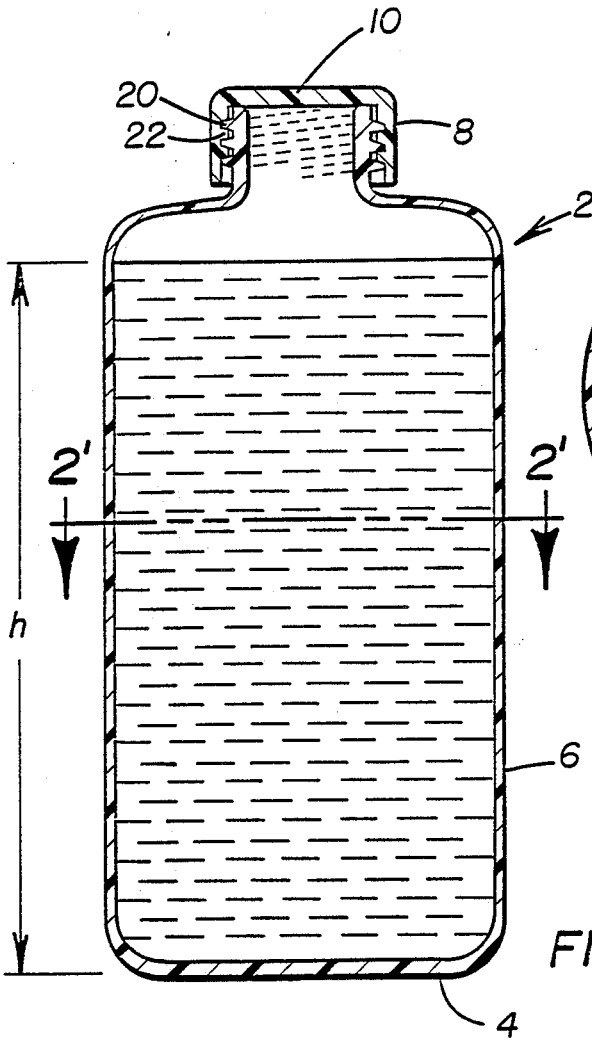
FIG. 1 shows a front elevational view of a typical container used to house the liquid nonaqueous detergent.

As mentioned above, the present invention provides a packaging system for a stable, liquid nonaqueous detergent, in which the solids portion is stably dispersed throughout the liquid portion and maintained in dispersion by the use of a stabilizer comprising a lower alkylated fused ring polyarylene sulfonate, and the liquid/-solid interaction between the liquid detergent and the plastic wall of the bottle is minimized. Further standard detergent adjuncts, especially enzymes, can be present in the detergent compositions.

Liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product.

The liquid detergent of the present invention is claimed in the application of David Peterson et al., "STABLE LIQUID NONAQUEOUS DETERGENT," filed concurrently herewith Ser. No. 07/251/719 and of common assignment. Said application is incorporated by reference thereto. In said detergent, a liquids portion, comprising substantially nonionic surfactants, suspends a solids portion which substantially comprises builders and oxidants, as well as other solid adjuncts. However, in order to maintain fluidity, the nonionic surfactant is present in a substantial excess to the solids portion. The problem presented by the liquid, nonionic surfactant predominating is that the liquids and solids portion will have a tendency to undergo phase separation. This will result in visible, discrete layers in the liquid, the solids portion settling to the bottom of the liquid. That problem was resolved by using a two component stabilizing system.

However, it was also determined that if a standard packaging plastic, polypropylene, of a certain dimension, were used to make the containers housing the detergent, phase instability resulted.

This problem was unexpected. However, even more surprisingly, applicants have determined that if certain internal dimensions of the containers are carefully selected, or a different material is used to construct the containers, the phase instability is surprisingly arrested or mitigated.

I. The Container

The plastic vessels, which can be bottles or jugs, are typically blow-molded plastics made of high density polyethylene (HDPE) and copolymers thereof. High density polyethylenes are particularly preferred for use in this invention. These types of polymers lend themselves very well to blow-molding and other manufacturing methods for making liquid-bearing bottles. These high density polyethylenes are manufactured by polymerizing ethylene under relatively low pressure in the presence of efficient catalysts, such as titanium halide-aluminum alkyl (Ziegler process) and chromium oxide promoted silica catalysts (Phillips process). There is also a new generation of HDPE's now available from DuPont/Nissei. These polymers have a density of about 0.940 g/cm$^3$ and greater, more preferably about 0.941–0.959 g/cm$^3$ for high density copolymers, and greater than, or equal to, 0.960 g/cm$^3$ for high density homopolymers. Typical homopolymers have a density of about 0.960–0.965 g/cm$^3$ yielding toughness and high shatter-resistance. It is most preferred to use copolymers with densities between 0.95 and 0.96. Conversely, while density is favored for rigidity and strength, it is sought to be reduced for increase in stress-cracking resistance and maintaining load bearing capacity. Molecular weight of the plastic should also be controlled to impart appropriate characteristics to the plastic. In these high density polyethylenes, density has an approximately inverse relation to molecular weight, as usually measured via melt index in units of g/10 min. As molecular, weight increases, improvement in resistance to environmental stress cracking improves. Table I and II below relates these relationships (these tables are for illustration purposes only, since they are based on ASTM test methods that do not involve liquid detergents; but they do indicate general trends for these grades of plastics):

TABLE I

Melt Index and Molecular Weight Relationship in Linear High Density Polyethylene[1]

| Melt Index g/10 min. | $\overline{M}_w$[2] | ESCR[3] |
|---|---|---|
| 0.2 | 175,000 | 60 |
| 0.5 | 160,000 | |
| 1.0 | 140,000 | 14 |
| 5 | 90,000 | 1 |
| 10 | 75,000 | — |
| 20 | 60,000 | — |

[1]Adapted from "Olefin Polymers (Linear HDPE)". Kirk-Othmer Encyclopedia of Chemical Technology, 3rd Ed., Vol. 16, pp. 421–433 (1981), incorporated herein by reference.
[2]weight average molecular weight.
[3]Environmental stress crack resistance, Bell Test, number of hours to achieve 50 failures.

TABLE II

Density Dependent Properties of HDPE[a]

| Density, g/cm$^3$ | ESCR[b] |
|---|---|
| 0.94 | 700 |
| 0.95 | 100 |
| 0.96 | 20 |

[a]Adapted from "Olefin Polymers (Linear HDPE)". Kirk-Othmer Encyclopedia of Chemical Technology, 3rd Ed., Vol. 16, pp. 421–33 (1981), incorporated herein by reference.
[b]Environmental Stress Crack Resistance, Bell test, number of hours to achieve 50% failures.

For blown bottles used to house liquid detergents, a density of about 0.950–0.956 g/cm$^3$ and a melt index of about 0.1–0.5, most preferably 0.20–0.40, g/10 min. are preferred. In the invention, these particular parameters for these HDPE bottles are especially preferred.

Despite the impressive amount of knowledge that is known about high density polyethylene which is used to make blow-molded bottles and about designing appropriate parameters for bottles which contain liquid detergents, in fact, when a liquid essentially nonaqueous detergent is added to the bottles, the detergent interacts with the plastic of these bottles, apparently due to a liquid/solid interaction in which the substantially nonaqueous liquid appears to "migrate" towards the plastic. This interaction is not entirely understood, so the foregoing remarks are meant as an explanation, but Applicants are not thereby bound, as other plausible, but, as yet, unknown mechanisms may be responsible. This problem has neither been heretofore recognized nor addressed in the prior art.

Blown HDPE bottles can have their properties modified by additives. For instance, it is preferred to modify the density of the polyethylene resin by co-polymerizing a small amount of a short chain alkylene, e.g., butene, hexene or octene, with the ethylene. Various other additives could be added, such as colorants, opacifying agents, and antioxidants, such as hindered phenols, e.g., BHT, Irganox 1010 (Ciba-Geigy A.G.), Irganox 1076 (Ciba-Geigy A.G.), Ionol (Shell Chemical Co.). Mold release agents and plasticizers could be added, especially to other types of plastics.

Suitable methods of forming and manufacturing the vessels of the invention are disclosed in *Kirk-Othmer, Encyclopedia of Chemical Technology,* 3rd Ed., Vol. 18, pp. 184–206 (1982), the disclosure of which is incorporated herein by reference.

It is particularly preferred that bottles of this invention be blow-molded. This is usually accomplished by, generally, providing a mold into which is introduced molten resin in the form of a parison. After the air is fed into the die, the parison expands to fill the mold and then is cooled to form the bottle. Thereafter, the bottle is removed from the mold.

Further, the bottles of the invention typically will have a relatively thin-walled construction, e.g., or 0.005–0.1 in., most preferably about 0.010 in. minimum. These vessels will typically have an appropriate interior volume ranging from one pint (16 fl. oz) to one and one-half gallon (192 fl. oz). (Other volumetric measures e.g., metric, are possible). The bottles have an end wall or panel, preferably circular, from which depends a circumscribing side wall. The side wall typically narrows into a depending finish and said finish is provided with a separate closure, which typically is screw-threaded and rotationally closes down on the finish which is usually provided with mating threads. See FIGS. 1–2 for a representative example. Although not critical to the invention, the closure may be constructed of plastic which is generally different from the plastic used for the bottle, and typically is manufactured by different processing methods, e.g., injection molding.

Figure 2:
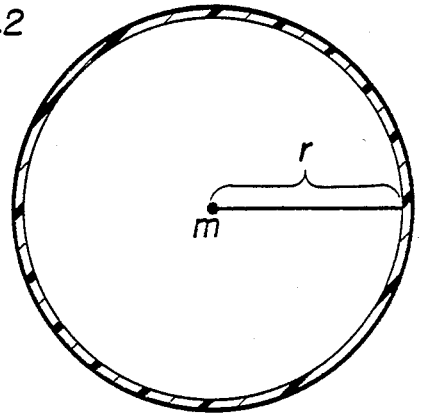
FIG. 2 is a plan view of the container of FIG. 1 partially in section, taken along lines 2'—2' of FIG. 1.
Figure 3:
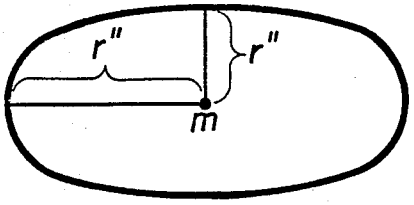
FIG. 3 is a plan view of another embodiment of the container, partially in section.

Referring now to FIG. 1, a typical container used to contain a substantially nonaqueous detergent, 2* is depicted. The container 2 has an end panel or wall 4*, preferably circular, from which depends a circumscribing side wall 6*. The side wall 6* narrows into a finish 8*, which may be provided with threads 20* and a closure 10* which is provided with mating threads 22* to rotationally close down on the finish 8*. Spouts or other pouring implements may be added to the finish or integrated therewith. Container 2* has a height, h. In FIG. 2, a plan view of the interior of the container taken along lines 2'—2', is depicted. From midpoint m, the radius, r, of the container can be determined. In FIG. 3, another plan view of a modified container is depicted. This container is ovular in shape. The critical dimension in this container is r'.

Critical Dimensions

In the following discussion, certain assumptions must be made in describing the critical dimensions of the detergent containers. First, although liquid detergent containers are diverse in quantity contained and design, for the purposes of the invention, a cylindrical shape is assumed. The cylinder is a significant model since it allows one to calculate the significant cross-sectional dimension r/2 free from the need to account for complex dimensions provided by other isometric shapes, e.g.s., hexahedrons, octahedrons, etc. Second, excessively sharp angles are to be avoided since that can increase the surface area to which the liquid detergent is exposed. In determining the critical dimension, r/2, the following formula is derived:

$$\frac{\text{Volume of cylinder:}}{\text{Area of cylinder:}} = \frac{\pi r^2 h}{2\pi r h} = r/2$$

From study of this model and empirical evidence, it has been determined that increased phase separation of the liquid detergent contained in these plastic containers occurred when the surface area of the container was decreased with respect to volume. Thus, at a lesser volume (volume being inversely relational to surface area), more phase instability occurred. This is best quantified by using the cross-sectional dimension r/2. When r/2 is greater than about 6.8 mm (millimeters), phase separation due to plastic/liquid detergent interaction is substantially decreased. It is even more preferred to have r/2 greater than about 12 mm. It is to be understood that r/2 is a measurement of the radius measured from the midpoint of the container to the closest wall, see, e.g., FIG. 3, wherein r' is the radius of the midpoint to the closest wall.

Heteroatom-Containing Plastics

In another embodiment of this invention, it has been further surprisingly found that if a heteroatom-containing plastic material is used as the material for constructing the containers, phase stability of the liquid detergent is controlled. In this embodiment, polyvinyl chloride, suitably modified polystyrene, or copolymers thereof, are preferred for use. While certain materials, such as acrylonitrile, polyethylene terephthalate, polyethylene terephthalate glycol, polycarbonates, nylon and ABS (acrylonitrile butadiene styrene), polymers could be used, it is generally preferred to use cheaper plastics for ease of manufacture and to avoid high material costs. Mixtures of these resins are possible.

Applicants are again uncertain why the use of these particular materials minimizes phase instability problems in the liquid detergent contained in the containers, but theorize, without being thereby bound, that such heteroatom-containing plastics do not destabilize the substantially nonaqueous, organic liquid detergent because of certain intermolecular forces, or the like. This is merely one possible explanation. There may be other plausible theories, which are not binding on Applicants.

II. The Liquid Detergent

In the following description, the components of the liquid detergent are described.

1. Liquids Portion:

The liquid portion comprises substantially only liquid, nonionic surfactant, although amounts of some other liquids, such as solvents, liquid hydrotropes, and the like may also be present. The nonionic surfactant present in the invention will preferably have a pour point, or combination of nonionic solvent, of less than about 40° C., more preferably less than 30° C., and most preferably below 25° C. They will have an HLB (hydrophile-lipophile balance) of between 2 and 16, more preferably between 4 and 14, and most preferably between 9 and 12. However, mixtures of lower HLB surfactants with higher HLB surfactants can be present as the liquid portion of the detergent, the resulting HLB usually being an average of the two or more surfactants. Additionally, the pour points of the mixtures can be, but are not necessarily, weighted averages of the surfactants used.

The nonionic surfactants are preferably selected from the group consisting of $C_{8-18}$ alcohols with 1-15 moles of ethylene oxide per mole of alcohol, $C_{6-18}$ alcohols with 1-10 moles of propylene oxide per mole of alcohol, $C_{6-18}$ alcohols with 1-15 moles of ethylene oxide and 1-10 moles of propylene oxide per mole of alcohol, $C_{6-18}$ alkylphenols with 1-15 moles of ethylene oxide or propylene oxide or both, and mixtures of any of the foregoing. Certain suitable surfactants are available from Shell Chemical Company under the trademark Neodol. Suitable surfactants include Neodol 23-6.5 ($C_{12}$-alcohol with an average 6.5 moles of ethylene oxide per mole of alcohol), Neodol 25-9 ($C_{12-15}$ alcohol with an average 9 moles of ethylene oxide per mole of alcohol) and Neodol 25-3 ($C_{12-15}$ alcohol with an average 3 moles of ethylene oxide per mole of alcohol). These and other nonionic surfactants used in the invention can be either linear or branched, or primary or secondary alcohols. If these surfactants are partially unsaturated, they can vary from $C_{10-22}$ alkoxylated alcohols, with a minimum iodine value of at least 40, such as exemplified by Drozd et al., U.S. Pat. No. 4,668,423, which is incorporated herein by reference. If the surfactants are partially propoxylated, they can vary from propoxylated $C_{8-24}$ alcohols. An example of an ethoxylated propoxylated alcohol is Surfonic JL-80X ($C_{9-11}$ alcohol with about 9 moles of ethylene oxide and 1.5 moles of propylene oxide per mole of alcohol).

Other suitable nonionic surfactants may include polyoxyethylene carboxylic acid esters, fatty acid glycerol esters, fatty acid and ethoxylated fatty acid alkanolamides, certain block copolymers of propylene oxide and ethylene oxide and block polymers of propylene oxide and ethylene oxide with propoxylated ethylene diamine (or some other suitable initiator). Still further, such semi-polar nonionic surfactants as amine oxides, phosphine oxides, sulfoxides and their ethoxylated derivatives, may be suitable for use herein.

Nonionic surfactants are especially preferred for use in the liquid detergent since they are generally found in liquid form, usually contain 100% active content, possess little water, and are particularly effective at removing oily soils, such as sebum and glycerides.

2. Solids Portion:

The solids portion of the liquid detergent, as previously mentioned, substantially comprises alkaline builders, inorganic oxidants, and other adjuncts which are granular or particulate in nature, such as enzymes and pigments. However, the present discussion is limited to builders and oxidants.

The builders are typically alkaline builders, i.e., those which in aqueous solution will attain a PH of 7-14, preferably 9-12. Examples of inorganic builders include the alkali metal and ammonium carbonates (including sesquicarbonates and bicarbonates), silicates (including polysilicates and metasilicates), phosphates (including orthophosphates, tripolyphosphates and tetrapyrophosphates), aluminosilicates (both natural and synthetic zeolites), and mixtures thereof. Carbonates are especially desirable for use in this invention because of their high alkalinity and effectiveness in sequestering heavy metals which may be present in hard water, as well as their low cost.

Organic builders are also suitable for use, and are selected from the group consisting of the alkali metal and ammonium sulfosuccinates, polyacrylates, polymaleates, copolymers of acrylic acid and maleic acid or maleic anhydride, nitrilotriacetic acid, ethylenediaminetetraacetic acid, citrates and mixtures thereof.

The oxidant, when an inorganic peroxide, generally comprises materials which, in aqueous solution, provide hydrogen peroxide. These include, preferably, the alkali metal percarbonates, perborates (both perborate monohydrate and perborate tetrahydrate), and hydrogen peroxide adducts. Other peroxygen sources may be possible, such as monopersulfates and monoperphosphates. In may also be possible to use organic oxidants, e.g., organic peroxides and organic peracids. Examples of applicable peracids may include hydrotropic peracids (e.g.s., Johnston, U.S. Pat. No. 4,100,095, and Coyne et al., U.S. patent application Ser. No. 06/899,461, filed Aug. 22, 1986, both of which are incorporated herein by reference) and surface active or hydrophobic peracids (e.g.s., Hsieh et al., U.S. Pat. No. 4,655,789, and Bossu, U.S. Pat. No. 4,391,725, both of which are incorporated herein by reference). In the liquid detergent, it is especially preferred to use sodium perborate monohydrate. This particular oxidant provides, on a weight basis, more hydrogen peroxide than another suitable material, sodium perborate tetrahydrate, since sodium perborate monohydrate contains only one mole of waters of hydration.

It is preferred that the detergent comprise about 20-90% of the liquid portion, and 5-50% of the solids portion stably suspended therein, said 5-50% of solids comprising substantially all builder, while 0-20% of an oxidant is simultaneously present. More preferably, 20-30% of the builder is present, along with 1-15% oxidant, most preferably 22-28% builder, along with 5-10% oxidant. However, the ratio of liquids portion to solids portion will generally range from about 3:1 to 1:1, more preferably at least 2:1 to 1:1.

The solids portion should generally have a particle size between 1-50 microns, more preferably between 1-30 microns, and most preferably between 1-25 microns, average particle size. Although many suppliers of these solids can provide a range of particle size, the desired particle size can also be obtained by using ball mills or grinders.

1. Stabilizer:

The stabilizer is a lower alkylated fused ring polyarylene sulfonate.

The lower alkylated fused ring polyarylene sulfonates are also referred to as sulfonated, alkylated condensed ring aryl compounds. Aromatic radicals comprising the fused ring system can include naphthalene, anthracene, phenanthrene. Especially preferred herein are lower alkylated naphthalene sulfonates. "Lower alkylated" generally refers to $C_{1-4}$ alkyls. These alkyls can be straight chain, or branched. Especially preferred alkylated naphthalene sulfonates are the alkali metal cation salts (potassium, sodium or lithium) thereof.

Especially preferred for use herein is diisopropylnaphtalene sulfonate. One such example is Nekal BA-77 (75% active), sold by GAF Chemicals.

The present stabilizing system has demonstrated unusually dramatic and unexpected improvement in physical stability in these liquid detergents. While it is presently unknown exactly why this is so, Applicants speculate, without being bound by theory, that the anionic nature of the stabilizer may be responsible for the improved dispersion of the solids in the liquids portion. Additionally, again, without being bound to theory, the stabilizing system apparently improves stability by preventing particle settling. Also, the use of this stabilizing system apparently provides desirable rheological properties, such as higher yield value, without an undesirably large increase in viscosity. This liquid detergent is a thixotropic liquid, which flows upon adequate shearing. The present invention has a preferable viscosity of about 1-5,000 centipoises (CPS), more preferably 5-2,000 CPS, and most preferably 10-1,500 CPS. The amount of phase stabilizer is about 1-20%, more preferably 1-10%, and most preferably, 3-10%.

Furthermore, this detergent does not gel up, or cease being flowable, even if added amounts of water up to about 20% are present. This was especially surprising since water addition to nonaqueous nonionic liquid detergents tends to cause gelling or stiffening of the liquid matrix, as a result of a complex network forming in the detergent. This may be an interaction between the solids (especially inorganic alkaline builders), the surfactants, and the water, although this theory is not binding on Applicants and mainly offered as a possible explanation. A gel is thus considered here a nonpourable liquid. Water is a potential problem in these sorts of detergents since extraneous water from sources such as condensation in an area where the detergent container is stored (especially where there are temperature fluctuations), or high humidity, or where the user deliberately or accidentally adds water to the container, e.g., while rinsing the container closure or the bottle. This latter category is especially prevalent when the closure is used as a measuring device, and the user rinses the closure before recombining it with the container.

In another version of the liquid detergent, it is preferred to add 0-40% of an additional phase stabilizer in combination with the lower alkylated fused ring polyarylene stabilizer. These stabilizers are generally selected from anionic sulfates and sulfonates. Non-limiting examples are $C_{6-18}$ alkyl aryl sulfonates; $C_{6-18}$ alkyl ether sulfates (which contain 1-10 moles of ethylene oxide per mole of alcohol, exemplary of which is Neodol 25-3S, Shell Chemical Company; $C_{8-18}$ alkyl sulfosuccinates, e.g., Aerosol OT, American Cyanamid; $C_{8-18}$ alkyl sulfates; secondary alkane (paraffin) sulfonates, e.g., Hostapur SAS, Farbwerke Hoechst A.G.; alpha-olefin sulfonates; and alkylated diphenyl oxide disulfonates, e.g., Dowfax surfactants, Dow Chemical Company. This additional stabilizer is preferably a $C_{6-18}$ alkyl aryl sulfonate.

The $C_{6-18}$ alkyl aryl sulfonates are typically considered anionic surfactants. Especially preferred are $C_{9-18}$ alkyl benzene sulfonates, and most especially preferred are $C_{10-14}$ alkyl benzene sulfonates. An example thereof is Calsoft F-90 (90% active, solid), sodium alkyl benzene sulfonate, available from Pilot Chemical Company. The acidic form of these surfactants, HLAS, may also be appropriate. For example, Biosoft S-130, available from Stepan Chemical Company, may also be suitable for use herein. See also the description of acidic surfactants in Choy et al., U.S. Pat. No. 4,759,867, incorporated herein by reference.

When the combination of phase stabilizers is used, it is preferred that the two constituents of the thus formed stabilizing system be in a ratio of about 10:1 to about 1:10, more preferably 4:1 to 1:4, and most preferably 3:1 to 1:3.

4. Hydrolytic Enzymes:

Enzymes are especially desirable adjunct materials in these liquid detergents. Unlike aqueous detergents, these substantially nonaqueous detergents may be able to maintain the chemical stability, that is, the activity, of these enzymes markedly better, since water is substantially not present to mediate enzyme decomposition, denaturation or the like.

Proteases are one especially preferred class of enzymes. They are selected from acidic, neutral and alkaline proteases. The terms "acidic," "neutral," and "alkaline," refer to the pH at which the enzymes' activity are optimal. Examples of neutral proteases include Milezyme (available from Miles Laboratory) and trypsin, a naturally occurring protease. Alkaline proteases are available from a wide variety of sources, and are typically produced from various microorganisms (e.g., *Bacillis subtilisin*). Typical examples of alkaline proteases include Maxatase and Maxacal from International BioSynthetics, Alcalase, Savinase and Esperase, all available from Novo Industri A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase, from Société Rapidase, Milezyme from Miles Laboratory, and Maxamyl from International BioSynthetics.

Still other suitable enzymes are cellulases, such as those described in Tai, U.S. Pat. No. 4,479,881, Murata et al., U.S. Pat. No. 4,443,355, Barbesgaard et al., U.S. Pat. No. 4,435,307, and Ohya et al., U.S. Pat. No. 3,983,082, incorporated herein by reference.

Yet other suitable enzymes are lipases, such as those described in Silver, U.S. Pat. No. 3,950,277, and Thom et al., U.S. Pat. No. 4,707,291, incorporated herein by reference.

The hydrolytic enzyme should be present in an amount of about 0-5%, more preferably 0.01-3%, and most preferably 0.1-2% by weight of the detergent. Mixtures of any of the foregoing hydrolases are desirable, especially protease/amylase blends.

5. Adjuncts:

The standard detergent adjuncts can be included in the present liquid detergent. These include dyes, such as Monastral blue and anthraquinone dyes (such as those described in Zielske, U.S. Pat. No. 4,661,293, and 4,746,461). Pigments, which are also suitable colorants, can be selected, without limitation, from titanium dioxide, ultramarine blue (see also, Chang et al., U.S. Pat. No. 4,708,816), and colored aluminosilicates. Fluorescent whitening agents are still other desirable adjuncts. These include the stilbene, styrene, and naphthalene derivatives, which upon being impinged by visible light, emit or fluoresce light at a different wavelength. These FWA's or brighteners are useful for improving the appearance of fabrics which have become dingy through repeated soilings and washings. A preferred FWA is Tinopal CBS-X, from Ciba Geigy A.G. Examples of suitable FWA's can be found in U.S. Pat. Nos. 1,298,577, 2,076,011, 2,026,054, 2,026,566, 1,393,042, 3,951,960, 4,298,290, 3,993,659, 3,980,713 and 3,627,758, incorporated herein by reference. Anti-redeposition agents, such as carboxymethylcellulose, are potentially desirable. Next, foam boosters, such as appropriate anionic surfactants, may be appropriate for inclusion herein. Also, in the case of excess foaming resulting from the use of certain nonionic surfactants, anti-foaming agents, such as alkylated polysiloxanes, e.g., dimethylpolysiloxane would be desirable. Also, certain solvents, such as glycol, e.g.s., propylene glycol, and ethylene glycol, certain alcohols, such as ethanol or propanol, and hydrocarbons, such as paraffin oils, e.g., Isopar K from Exxon U.S.A., may be useful to thin these liquid compositions. Buffers may also be suitable for use, such as sodium hydroxide, sodium borate, sodium bicarbonate, to maintain a more alkaline pH in aqueous solution, and acids, such as hydrochloric acid, sulfuric acid, citric acid and boric acid, would be suitable for maintaining or adjusting to a more acidic pH. Next, bleach activators could well be very desirable for inclusion herein. This is because the present liquid detergent is substantially nonaqueous, and thus, the bleach activators, which are typically esters, may maintain their stability better than in other liquids since they would be less likely to be hydrolyzed in the substantially nonaqueous liquid composition. Suitable examples of appropriate bleach activators may be found in Mitchell et al., U.S. Pat. No. 4,772,290, Fong et al., published European Patent Application EP No. 185,522, Fong et al., published European Patent Application EP No. 267,047, Zielske et al., published European Patent Application EP No. 267,048, Zielske, published European Patent Application EP No. 267,046, Zielske, U.S. Pat. No. 4,735,740, Chung et al., U.S. Pat. No. 4,412,934, Hardy et al., U.S. Pat. No. 4,681,952, Wevers et al., U.S. Pat. No. 4,087,367, and Hampson et al., U.K. No. 864,798, all of which are incorporated herein by reference. Lastly, in case the composition is too thin, some thickeners such as gums (xanthan gum and guar gum) and various resins (e.g., polyvinyl alcohol, and polyvinyl pyrrolidone) may be suitable for use. Fragrances are also desirable adjuncts in these compositions.

The additives may be present in amounts ranging from 0–50%, more preferably 0–40%, and most preferably 0–20%. In certain cases, some of the individual adjuncts may overlap in other categories. For example, some buffers, such as silicates may be also builders. Also, some surface active esters may actually function to a limited extent as surfactants. However, the present invention contemplates each of the adjuncts as providing discrete performance benefits in their various categories.

Experimental

In Table III below, the stabilities of liquid detergents contained in containers made of high density polyethylene (HDPE) are compared with respect to r/2.

In these experiments, except for Example 1, all containers were made of HDPE and were cylindrical test tubes, with dimensions h (115 mm) and differing r/2 values. Example 1 was a polypropylene container which was a cylindrical test tube with a bottom tapering to an apex (cone shaped). The detergent tested had the formulation:

TABLE III

| Ingredient | |
|---|---|
| Nonionic Surfactant | 61.34[1] |
| Sodium Carbonate | 25.00 |
| Sodium Perborate Monohydrate | 6.00 |
| Calsoft F-90[3] | 3.34 |
| Nekal BA-77[4] | 3.23 |
| Fluorescent Whitening Agent | 0.53 |
| Enzyme | 0.58 |

[1]Neodol 23-6.5. Shell Oil Company.
[2]A mixture of 9 parts developmental surfactant (nonionic) to one part Neodol 23-6.5. Shell Oil Company.
[3]Sodium salt of linear $C_{11}$ alkyl benzene sulfonate. Pilot Chemical Company (90% active).
[4]Diisopropylnaphthalene sulfonate from GAF Chemicals.

The test was conducted at about 49° C. for 7 days. The amount of phase separation in % was measured as height of visible supernatant over total height of liquid volume.

TABLE IV

| Example | Container Material | r/2 | % Separation |
|---|---|---|---|
| 1 | Polypropylene | 6.8 | 4.4 |
| 2 | HDPE | 12 | 3.7 |
| 3 | HDPE | 14 | 2.8 |
| 4 | HDPE | 16 | 2.2 |
| 5 | HDPE | 20 | 1.5 |

As the above data demonstrate, the r/2 for a homopolymeric plastic used as the material for constructing the containers must be at least above 6.8.

In Table V below, the effect of using different container materials is demonstrated. The shape of the containers in these data were cylindrical, with h = 100 mm, r/2 = 10 mm. % separation was calculated as in Table IV.

TABLE V

| Material | LDPE[1] | HDPE[2] | PP[3] | PVC[4] |
|---|---|---|---|---|
| Run 1 | 1.0 | 2.0 | 1.5 | 1.0 |
| Run 2 | 1.6 | 2.0 | 2.0 | 1.0 |
| Run 3 | 2.0 | 4.0 | 1.0 | 1.6 |
| Run 4 | 1.5 | 1.6 | 2.1 | 1.0 |
| Average | 1.53 | 2.4 | 1.7 | 1.2 |
| $LSD_{Shefte}$ | 1.49 | | | |
| $LSD_{(T\text{-}Test)}$ | 1.00 | | | |

The above data in Table V confirms that using a heteroatom-containing resin will avoid the increase in phase instability when packaging the substantially nonaqueous liquid detergent therein.

The invention is further exemplified in the claims which follow. However, the invention is not limited thereby, and obvious embodiments and equivalents thereof are within the claimed invention.

We claim:

1. A package for a phase stable, liquid nonaqueous detergent composition, comprising:

a plastic, relatively thin-walled container, said container having an end wall and a circumscribing side wall which narrows to a finish, and a liquid detergent composition contained in said container, said detergent composition comprising:

(a) 20–90% of a liquid portion which comprises an alkoxylated nonionic surfactant;

(b) 5–50% of a solids portion which comprises:

(i) a builder;

(ii) 0–20% of an oxidant; said solids being stably suspended in said liquid portion, by means of (c) 0.5–20% of a sulfonated, lower alkylated condensed ring aryl compound; and (d) 0–5% of a hydrolytic enzyme;

whereby the phase stability of said liquid detergent composition in storage in said container is controlled, by the selection of either:

(1) said container being constructed of a homopolymeric resin, said container having a minimum average cross-sectional dimension r/2 of at least about 6.8 millimeters in order to minimize interaction with said plastic;

(2) said container being constructed of a heteroatom-containing polymer; or (3) a combination thereof.

2. The package of claim 1 wherein the phase stability control is provided by (1).

3. The package of claim 2 wherein said homopolymeric resin is selected from the group consisting of high density polyethylene, low density polyethylene and polypropylene.

4. The package of claim 3 wherein the resin is high density polyethylene with a density of about 0.950–0.956 g/cm$^3$ and a melt index of about 0.1–0.5.

5. The package of claim 1 wherein the the phase stability control is provided by (2).

6. The package of claim 5 wherein the polymer is selected from the group consisting of polyvinyl chloride, nylon, polyethylene terephthalate, polyethylene terephthalate glycol, acrylonitrile, polycarbonate, acrylonitrile-butadiene-styrene, polystyrene, and mixtures thereof.

7. The package of claim 1 wherein the detergent further comprises (e) an additional phase stabilizer selected from anionic sulfates and sulfonates.

8. The package of claim 1 wherein the phase stability control is provided by (3).

* * * * *